US011702929B2

(12) United States Patent
Gratia et al.

(10) Patent No.: US 11,702,929 B2
(45) Date of Patent: Jul. 18, 2023

(54) DETERMINING A STUCK PIPE LOCATION

(71) Applicant: Saudi Arabian Oil Company, Dhahran (SA)

(72) Inventors: Paolo Ilham Sola Gratia, Dhahran (SA); Juan Manuel Polo Terán, Dhahran (SA); Julio C. Guzman, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/515,992

(22) Filed: Nov. 1, 2021

(65) Prior Publication Data

US 2023/0135273 A1 May 4, 2023

(51) Int. Cl.
*E21B 47/09* (2012.01)
*E21B 47/002* (2012.01)
*E21B 47/008* (2012.01)

(52) U.S. Cl.
CPC ..... *E21B 47/09* (2013.01); *E21B 47/008* (2020.05); *E21B 47/0025* (2020.05)

(58) Field of Classification Search
CPC ..... E21B 47/09
See application file for complete search history.

(56) References Cited

U.S. PATENT DOCUMENTS

| | | | | |
|---|---|---|---|---|
| 3,973,444 | A | 8/1976 | Skinner et al. | |
| 9,759,031 | B2 | 9/2017 | Bakri et al. | |
| 2005/0240351 | A1* | 10/2005 | Gray | E21B 47/09 702/6 |
| 2015/0013975 | A1* | 1/2015 | McColpin | E21B 47/135 166/77.2 |
| 2016/0265905 | A1 | 9/2016 | Duncan et al. | |
| 2020/0400012 | A1* | 12/2020 | Lanticq | E21B 47/09 |

FOREIGN PATENT DOCUMENTS

| | | | |
|---|---|---|---|
| EP | 0194228 | A1 | 9/1986 |
| WO | 2017009671 | A1 | 1/2017 |

* cited by examiner

*Primary Examiner* — Giovanna Wright
(74) *Attorney, Agent, or Firm* — Dinsmore & Shohl LLP

(57) ABSTRACT

Embodiments for determining a stuck pipe location include determining that a pipe is stuck in a wellbore due to an obstruction; deploying a fiber optic stuck pipe location detector inside the pipe, activating a first fiber optic sensor to detect a baseline reading, and manipulating the pipe. Some embodiments include detecting micro-noises caused by the stretching of the pipe, wirelessly acquiring data related to the micro-noises from the first fiber optic sensor, and determining a location of the obstruction by comparing the baseline reading with the data related to the micro-noises. Some embodiments include recovering the pipe at a predetermined point around the location of the obstruction while leaving the first fiber optic sensor inside the pipe.

20 Claims, 6 Drawing Sheets

DETERMINING A STUCK PIPE LOCATION

TECHNICAL FIELD

Embodiments described herein generally relate to determining a stuck pipe location and, more specifically, to embodiments for utilizing a fiber optic sensor to determine a stuck pipe location.

BACKGROUND

Current procedures to determine a stuck pipe location include traditional pipe stretch calculations and/or electric line/wireline free-point logging tool. In these conventional processes utilizing a wireline free-point logging tool, the tool will be deployed to known free-pipe depth and record baseline reading while manipulating/moving the pipe. The tool is typically a magnetic or electromagnetic device that will be deployed to a plurality of other depths and will check the readings at these depths to compare with a baseline free-pipe reading. On each reading, the pipe has to be manipulated and/or moved. After a stuck pipe depth is confirmed, the tool is pulled out to surface and pipe the recovery job will proceed.

SUMMARY

Embodiments for determining a stuck pipe location include determining that a pipe is stuck in a wellbore due to an obstruction; deploying a fiber optic stuck pipe location detector inside the pipe, activating a first fiber optic sensor to detect a baseline reading, and manipulating the pipe. Some embodiments include detecting micro-noises caused by the stretching of the pipe, acquiring data related to the micro-noises from the first fiber optic sensor, and determining a location of the obstruction by comparing the baseline reading with the data related to the micro-noises. Some embodiments include recovering the pipe at a predetermined point around the location of the obstruction while leaving the first fiber optic sensor inside the pipe.

In another embodiment, a method for stuck pipe detection includes determining that a pipe is stuck in a wellbore due to an obstruction, deploying a fiber optic stuck pipe location detector inside the pipe at a first end of the pipe, where the fiber optic stuck pipe location detector includes a first fiber optic sensor, a ballast, and a computing device, and where deploying the fiber optic stuck pipe location detector inside the pipe includes allowing gravity to pull at least a portion of the first fiber optic sensor until at least one of the first fiber optic sensor or the ballast reaches a second end of the pipe. In some embodiments, once deployed, the first fiber optic sensor may passively rest inside the pipe without use of a securing mechanism. In some embodiments, the method includes activating the first fiber optic sensor to detect a baseline acoustic reading and a baseline temperature reading inside the pipe, manipulating the pipe by imparting at least one of tension, compression, or torsion to the pipe, and detecting, by the first fiber optic sensor, micro-noises caused by manipulating the pipe. Similarly, some embodiments include acquiring, by the computing device, data related to the micro-noises from the first fiber optic sensor, where acquiring includes at least one of the following: wirelessly acquiring the data or acquiring the data via a memory acquisition, determining a location of the obstruction by comparing the baseline acoustic reading, the baseline and the baseline temperature reading with the data related to the micro-noises, and recovering the pipe at a predetermined point around the location of the obstruction.

In yet another embodiment, a method includes determining that a pipe is stuck in a wellbore due to an obstruction and deploying a first fiber optic sensor inside the pipe at a first end of the pipe. In some embodiments, deploying the first fiber optic sensor inside the pipe includes allowing gravity to pull at least a portion of the first fiber optic sensor until the first fiber optic sensor reaches a second end of the pipe, and once deployed, the first fiber optic sensor passively rests inside the pipe without use of a securing mechanism. Some embodiments include activating the first fiber optic sensor to detect a baseline reading inside the pipe, manipulating the pipe by imparting at least one of tension, compression, or torsion to the pipe, and detecting, by the first fiber optic sensor, micro-noises caused by manipulating the pipe. In some embodiments, the method includes acquiring data related to the micro-noises from the first fiber optic sensor, determining a location of the obstruction by comparing the baseline reading with the data related to the micro-noises, and recovering the pipe at a predetermined point around the location of the obstruction.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Figure 1:
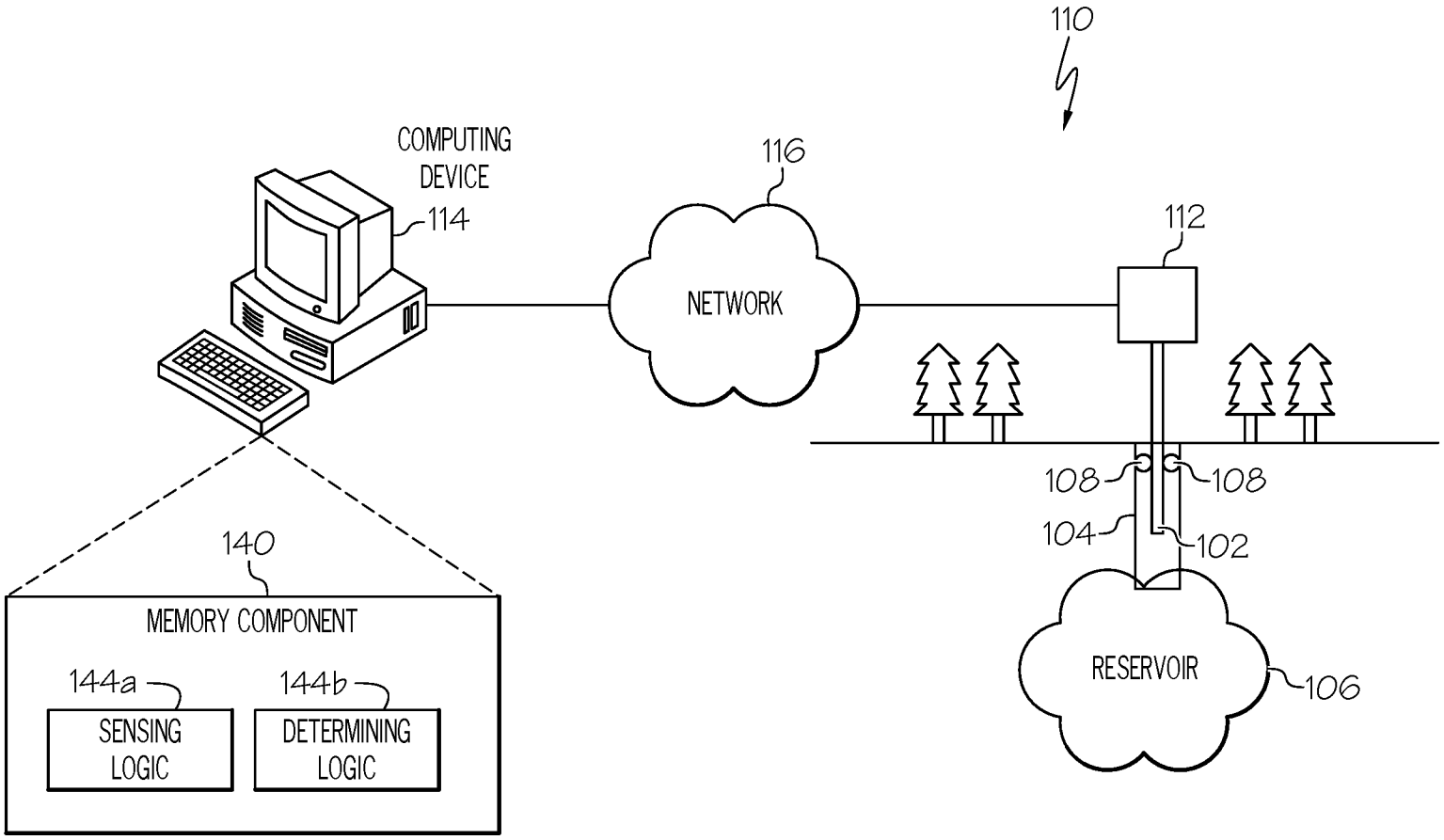
FIG. 1 depicts a drilling environment where a pipe may be stuck, according to embodiments described herein.

Embodiments disclosed herein are directed to determining a stuck pipe location. Some embodiments include a distributed sensing device, such as a fiber optic sensor or plurality of fiber optic sensors (such as a first fiber optic sensor, a second sensor, and/or a third fiber optic sensor) that monitor temperature and/or acoustic data and provides real time information along the wellbore from surface (e.g., a first end) to the bottom of the pipe (e.g., a second end). In some embodiments, separate fiber optic sensors may be utilized for temperature and acoustics. However, some embodiments may be configured to utilize a single fiber optic line for both types of sensing.

As will be understood, the fiber optic sensor effectively provides sensors throughout the entire length of the fiber optic line. Fiber optic sensors can be deployed into the stuck pipe by any of a plurality of methods such as electricline, slickline, coiled tubing, dropping probe method, etc. Based on fiber optic work principle, distributed fiber optic sensors can be utilized to detect stuck pipe location.

One embodiment of the workflow provided herein may include starting up fiber optic deployment and analyzer equipment. The fiber optic deployment and analyzer equipment may also be part of a fiber optic stuck pipe location detector, the fiber optic sensor, and/or a computing device. The fiber optic sensor may be constructed of a fiber optic line. In some embodiments, a ballast is also included. The workflow may additionally include deploying the fiber optic sensor and/or fiber optic line inside the stuck string/pipe to the bottom of the stuck pipe. Once the fiber optics are deployed to the second end of the pipe and laid down along the inner part of the pipe, embodiments may record a measurement to get baseline reading of acoustic, pressure, and/or temperature along the stuck pipe. Embodiments may additionally manipulate (e.g., pick up, slack off, rotate, etc.) the pipe. This manipulation may cause stretching of the pipe. As such, the embodiments may analyze the changes in acoustic, pressure, and/or temperature readings and locate the stuck pipe based on those changes. Embodiments may rig down the fiber optic stuck pipe location detector and proceed to the next pipe recovery job based on a defined stuck pipe location.

Due to the sensitivity of the fiber optic sensors, small changes in environment (such as pipe stretch) will be detected by the acoustic sensors of the fiber optic line. As an acoustic sensor, the fiber optic line acts as a microphone along the wellbore/pipe. When the pipe moves, the sensitive acoustic sensor picks up the sound from the stretching pipe. Depending on downhole condition, a stuck pipe condition could change by time. Stuck pipes could occur at multiple depths and stuck point can change due to environment changes. If the fiber optic line can be kept inside the pipe while deploying a pipe cutter, it can provide real time measurement just before making the cut to ensure the pipe is cut at the free pipe above the stuck point.

Utilizing fiber optic technology provides advantages in horizontal wellbore in which the risk of stuck pipe is higher. In current solutions, the free-point logging tool may not be able to reach a horizontal section unless a pumping down method is applied. In many cases pumping down may not work due to plugged string. If the free point logging tool manages to reach a horizontal section, multiple trips have to be performed in different depths to provide different reading comparisons with free pipe baseline reading. Utilizing the fiber optic technology of this disclosure, the fiber optic line will only be deployed once to the horizontal section. Once fiber optic is deployed, the pipe may be manipulated to get the reading and by following the above mentioned procedure, the acoustic sensors in the fiber optic can identify the stuck point location. Accordingly, embodiments provided herein are configured for the use of distributed acoustic and temperature measurements (sensing) to determine the stuck pipe of a pipe string in the sub-surface (inside a deep oil and gas well). The systems and methods for determining a stuck pipe location incorporating the same will be described in more detail, below.

Referring now to the drawings, FIG. 1 depicts a drilling environment where a pipe 102 may be stuck, according to embodiments described herein. As illustrated, the drilling environment includes a wellbore 104 that receives a pipe 102 for drilling into a reservoir 106. As also illustrated, an obstruction 108 may prevent the pipe 102 from being inserted into the reservoir 106 or removed from the wellbore 104. In some instances, a plurality of obstructions 108 may be positioned at a plurality of different points that cause the pipe 102 to be stuck.

While many current solutions require inaccurate and delicate electromagnetic sensors that must be moved to varying heights within the pipe 102 to approximate the location of the obstruction 108, embodiments described herein may utilize a fiber optic stuck pipe location detector 110 to determine the location of a stuck pipe, such as the pipe 102. The fiber optic stuck pipe location detector 110 may include a fiber optic sensor 112 (or more than one) and a computing device 114 that are coupled together via a network 116.

The network 116 may be any configured as any wide area network (such as PSTN, mobile network, the internet, satellite network, etc.), local network (such as wireless fidelity, local area network, etc.) and/or any peer to peer network (such as a ZigBee, near field communication, a wired connection, etc.). The computing device 114 may include any personal computer, server, tablet, mobile computing device, dedicated computing device, etc. for performing the functionality provided herein. As such, the computing device 114 includes a memory component 140 that stores sensing logic 144*a* and determining logic 144*b*. The sensing logic 144*a* may be configured to cause the computing device 114 to interpret signals from the fiber optic sensor 112. The determining logic 144*b* may cause the computing device 114 to utilize that data to determine a location of the obstruction 108, as described in more detail below.

Figure 2C:
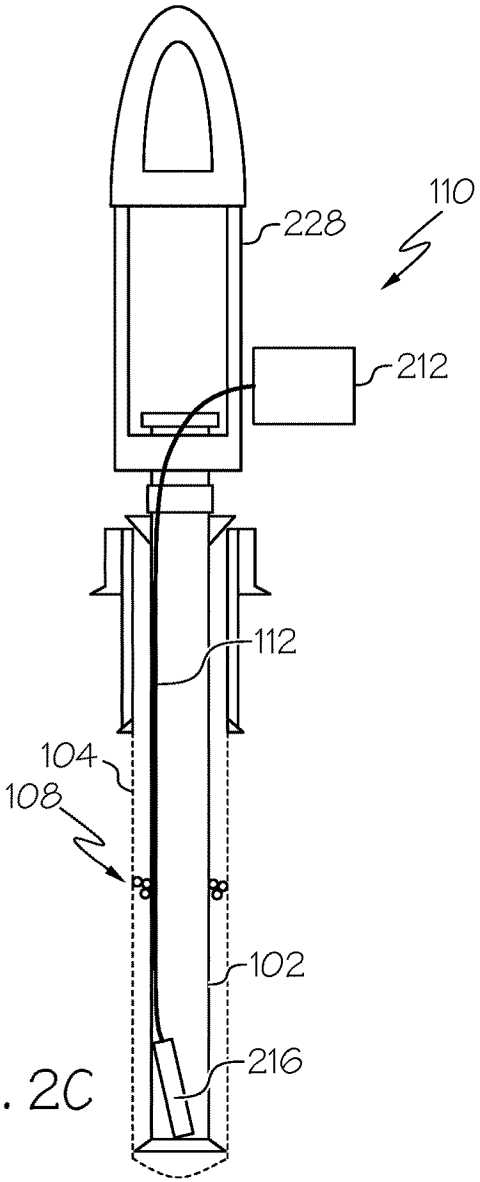
FIGS. 2A-2C depict utilization of a fiber optic stuck pipe location detector, according to embodiments described herein.
Figure 2B:
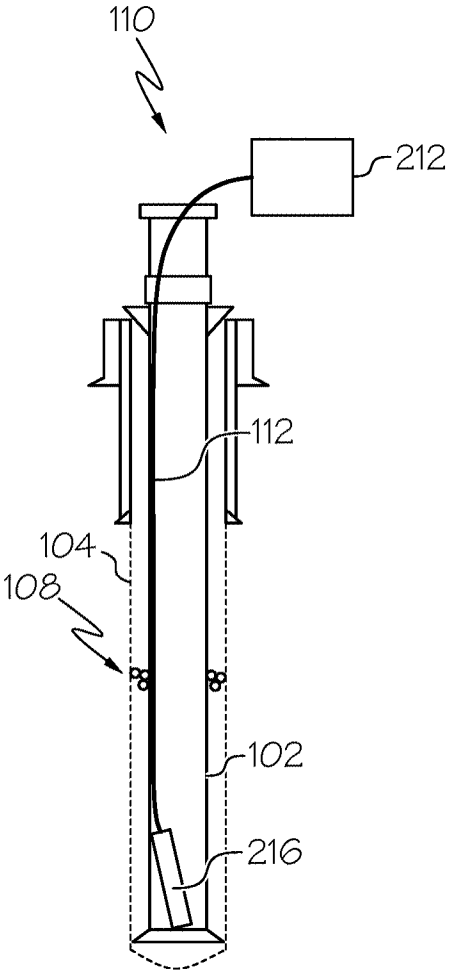
Figure 2A:
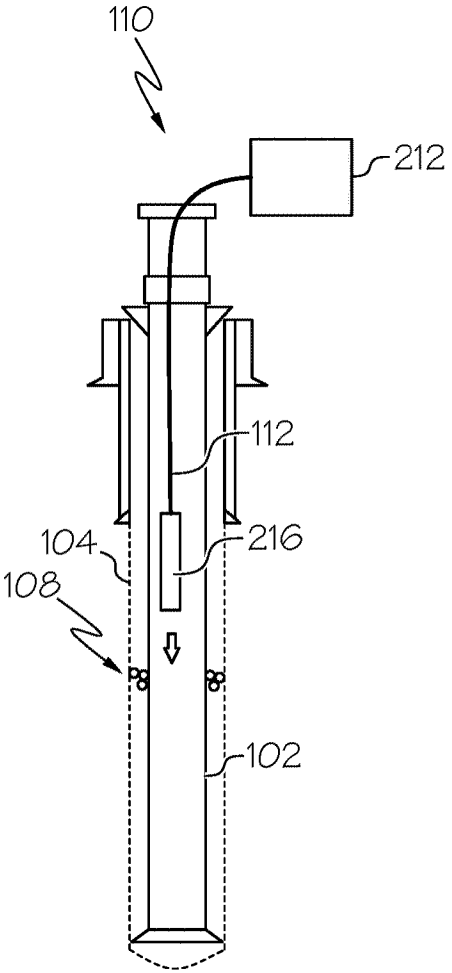

FIGS. 2A-2C depict utilization of a fiber optic stuck pipe location detector 110, according to embodiments described herein. As illustrated in FIG. 2A, the pipe 102 may be stuck due to the obstruction 108 in the wellbore 104. To detect the location of the obstruction 108, the fiber optic stuck pipe location detector 110 may be inserted into the pipe 102. The fiber optic stuck pipe location detector 110 may include an interrogator 212 for receiving the backscatter from the fiber optic sensor 112. In some embodiments, the interrogator 212 is part of the computing device 114 (FIG. 1). However, some embodiments may be configured such that the interrogator 212 communicates with the computing device 114. Regardless, the fiber optic sensor 112 is deployed into the pipe 102 and gravity (and/or other mechanisms) propels the fiber optic sensor 112 to a second end of the pipe 102. In some embodiments, a ballast 216 is coupled to the fiber optic sensor 112 to further assist deployment and the use of gravity.

As illustrated in FIG. 2B, the fiber optic sensor 112 is deployed and passively rests inside the pipe 102 without any securing mechanism that secures the fiber optic sensor 112 to the pipe 102. As this point, embodiments may take baseline readings of acoustic data, pressure data, and/or temperature data. Specifically, the interrogator 212 (and/or computing device 114 from FIG. 1) may inject a pulse of light through the fiber optic line of the fiber optic sensor 112. As this pulse of light travels through the fiber optic line, ambient acoustic, and/or temperature may cause tiny disturbances in the fiber optic line, which cause reflections of the pulse of light inside the fiber optic line. These reflections are known as backscatter. This backscattered light travels back through the fiber optic line to the interrogator 212 to determine the baseline readings. Additionally, a dedicated pressure sensor may be run to the end of the fiber optic sensor 112, which may be used for depth correlation/corrections by measuring hydrostatic pressure and pressure variations during movement of the pipe 102. It should also be understood that the pressure sensor at the end of the optic lines may serve for depth correlation and to make corrections for line movement while manipulating the pipe.

As illustrated in FIG. 2C, a pipe manipulator 228 may be introduced to the pipe 102 to introduce tension, compression, and/or torsion to the pipe 102. This manipulation of the pipe 102 causes micro-noises that are then sensed by the fiber optic sensor 112. Specifically, as the next pulse of light is traversing the fiber optic line, the micro-noise (and and/or temperature disturbance) causes backscatter that is different than ambient conditions. It should be noted that micro-noises may be used as an indicator of pipe deformation and/or friction within the wellbore. The pipe below the stuck point will not be able of generating the micro-noises. This backscatter may be time synchronized to accurately map the location of the disturbance. The result is continuous acoustic sampling along the entire length of the fiber optic line without cross talk.

It should be understood that while the computing device 114 from FIG. 1 is not explicitly depicted in FIGS. 2A-2C, embodiments configured herein may cause the interrogator 212 to communicate with the computing device 114. In some embodiments, the interrogator 212 is configured as a computing device for receiving and interpreting signals from the fiber optic sensor 112, as well as determining the location of the obstruction 108. Additionally, some embodiments of the interrogator 212 are not coupled to any other element, only the string of the pipe 102. In some embodiments, the interrogator 212 generates light pulses (laser); acquires the backscatter data; and may also process and interpret the backscatter data. In some embodiments, the backscatter data may be stored while the pipe 102 is manipulated and transferred to a remote computing device (such as the computing device 114 from FIG. 1). The data may also be transmitted in real time. Additionally, these features may be provided without physical attachment to another device and memory/wireless transmission enable manipulation of the pipe 102 without physical risk.

Figure 3:
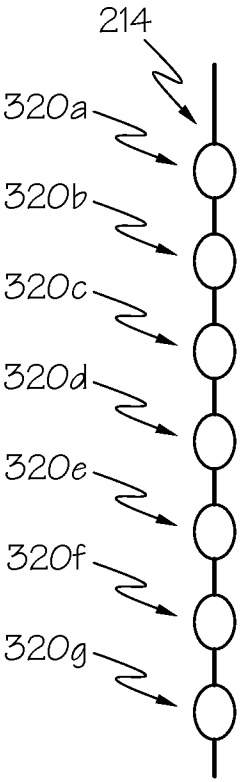
FIG. 3 depicts utilizing a fiber optic acoustic sensor for determining a stuck pipe location, according to embodiments described herein.

FIG. 3 depicts a fiber optic acoustic sensor 214 for determining a stuck pipe location, according to embodiments described herein. As illustrated in FIG. 3, the fiber optic sensor 112 may effectively create a plurality of acoustic sensors (or a continuous acoustic sensor) throughout the fiber optic line. While the fiber optic line may not have actual sensors disposed therein, due to the use of distributed acoustic sensing, embodiments described herein essentially create a first acoustic sensor 320*a*, which will pick up higher acoustic sound from pipe stretch compare to a second acoustic sensor 320*b*. The second acoustic sensor 320*b* will pick up higher acoustic sound compare to a third acoustic sensor 320*c*. By analyzing the readings from different acoustic sensors 320*a*-320*g* throughout the fiber optic line, the distributed fiber optic sensing configuration enables meaningful measurements to detect minute variations of stuck points due to its ability to provide high data density, hence provide accurate location of obstructions 108 causing a pipe 102 to be stuck.

Figure 4:
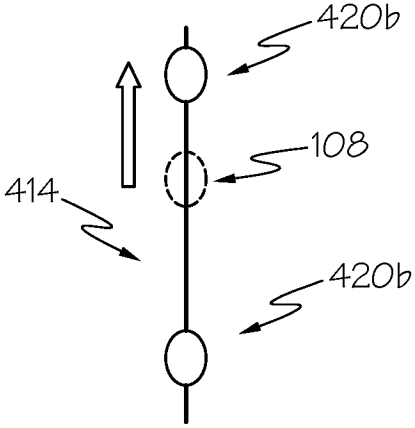
FIG. 4 depicts utilizing a fiber optic temperature sensor for determining a stuck pipe location, according to embodiments described herein.

FIG. 4 depicts utilizing a fiber optic temperature sensor 414 for determining a stuck pipe location, according to embodiments described herein. In addition to acoustic sensing, the fiber optic line and distributed sensing technique may be utilized to create virtual temperature sensors as complementary confirmation of stuck pipe location. Depending on how the fiber optic lines are laid inside the pipe 102, after manipulating the pipe 102, the temperature sensor 420*a* below the stuck point may show a different pressure reading than the temperature sensor 420*b*.

Figure 5:
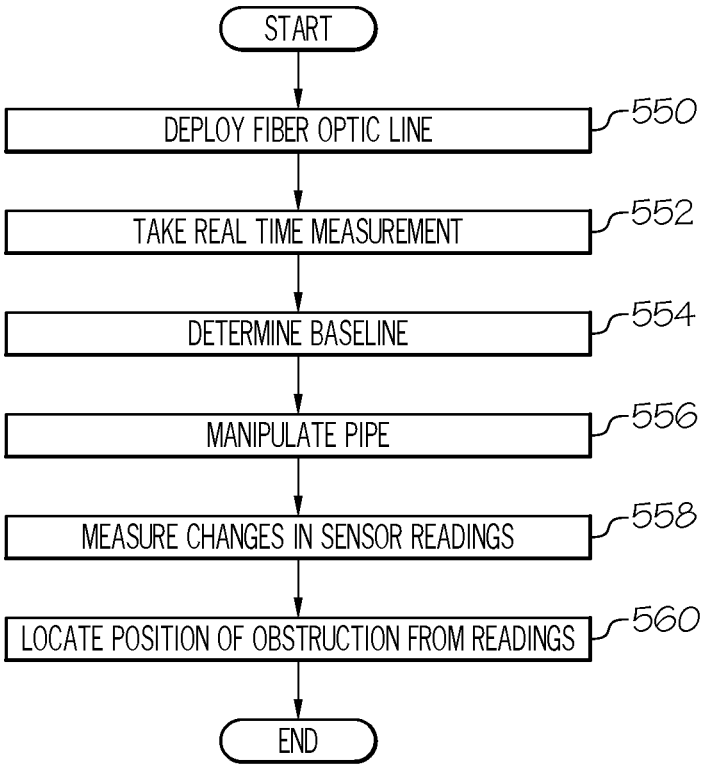
FIG. 5 depicts a flowchart for determining a stuck pipe location, according to embodiments described herein.

FIG. 5 depicts a flowchart for determining a stuck pipe location, according to embodiments described herein. As illustrated in block 550, the fiber optic sensor 112 may be deployed inside the pipe 102. As described above, the fiber optic sensor 112 may be coupled to a ballast 216 (FIG. 2) to assist gravity in deploying the fiber optic sensor 112. This allows embodiments described herein to have the fiber optic sensor 112 passively inside the pipe 102 without any securing mechanism. Additionally, this also allows embodiments provided herein to not need heavy equipment to deploy, attach, or retract the fiber optic sensor 112.

In block 552, the fiber optic sensor 112 and/or the fiber optic stuck pipe location detector 110 may take a real time measurement. The real time measurement may include an acoustic measurement and/or a temperature measurement. In block 554, a baseline may be determined for the measurement. In block 556, the pipe 102 may be manipulated. As discussed above, the pipe 102 may be manipulated by tension, compression, and/or torsion. In block 558, the fiber optic stuck pipe location detector 110 may measure changes in the sensor readings. In block 560, a position of the obstruction 108 may be determined from the readings.

Figure 6:
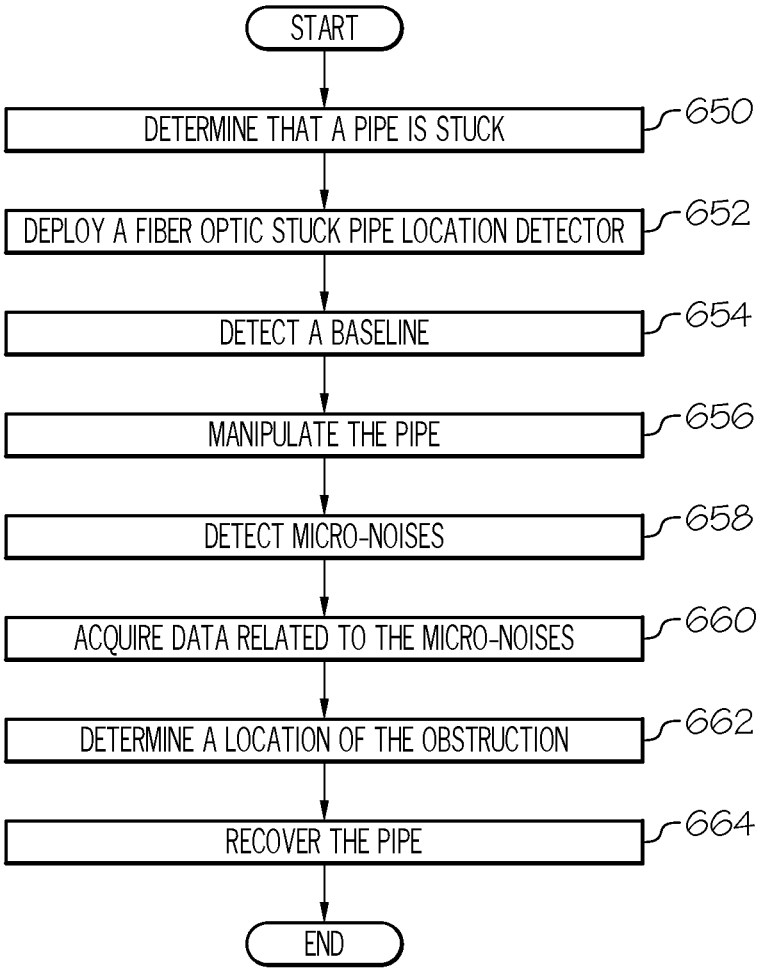
FIG. 6 depicts another flowchart for determining a stuck pipe location, according to embodiments describe herein.

FIG. 6 depicts another flowchart for determining a stuck pipe location, according to embodiments describe herein. As illustrated in block 650, a determination may be made that a pipe 102 is stuck in a wellbore 104 due to an obstruction 108. In block 652, a fiber optic stuck pipe location detector 110 may be deployed into a first end of the pipe 102 until at least a portion of the fiber optic stuck pipe location detector 110 reaches a second end of the pipe 102. In some embodiments, the fiber optic sensor 112 may be deployed into a pipe 102 with just a reel, allowing gravity to pull the fiber optic sensor 112 to the second end of the pipe 102. It should be understood that while the second end of the pipe 102 may be a terminal end of the pipe 102, this is not a requirement. Any position in the pipe 102 may be utilized as the second end, but in some embodiments, the second end represents a location of the pipe 102 that the operator or computing device 114 knows is opposite the first end relative to the obstruction 108.

In block 654, the fiber optic sensor 112 may detect a baseline acoustic reading, and/or a baseline temperature reading. In block 656, the pipe 102 may be manipulated by imparting at least one of tension, compression, or torsion to the pipe 102. In block 658, micro-noises may be detected, where the micro-noises are a result of stretching of the pipe 102. In block 660, data related to the micro-noises may be acquired (such as wirelessly and/or via a memory acquisition) from the fiber optic sensor 112. In block 662, a location of the obstruction 108 may be determined. In block 664, the pipe 102 may be recovered around the location of the obstruction 108, while leaving the fiber optic sensor 112 inside the pipe 102.

Figure 7:
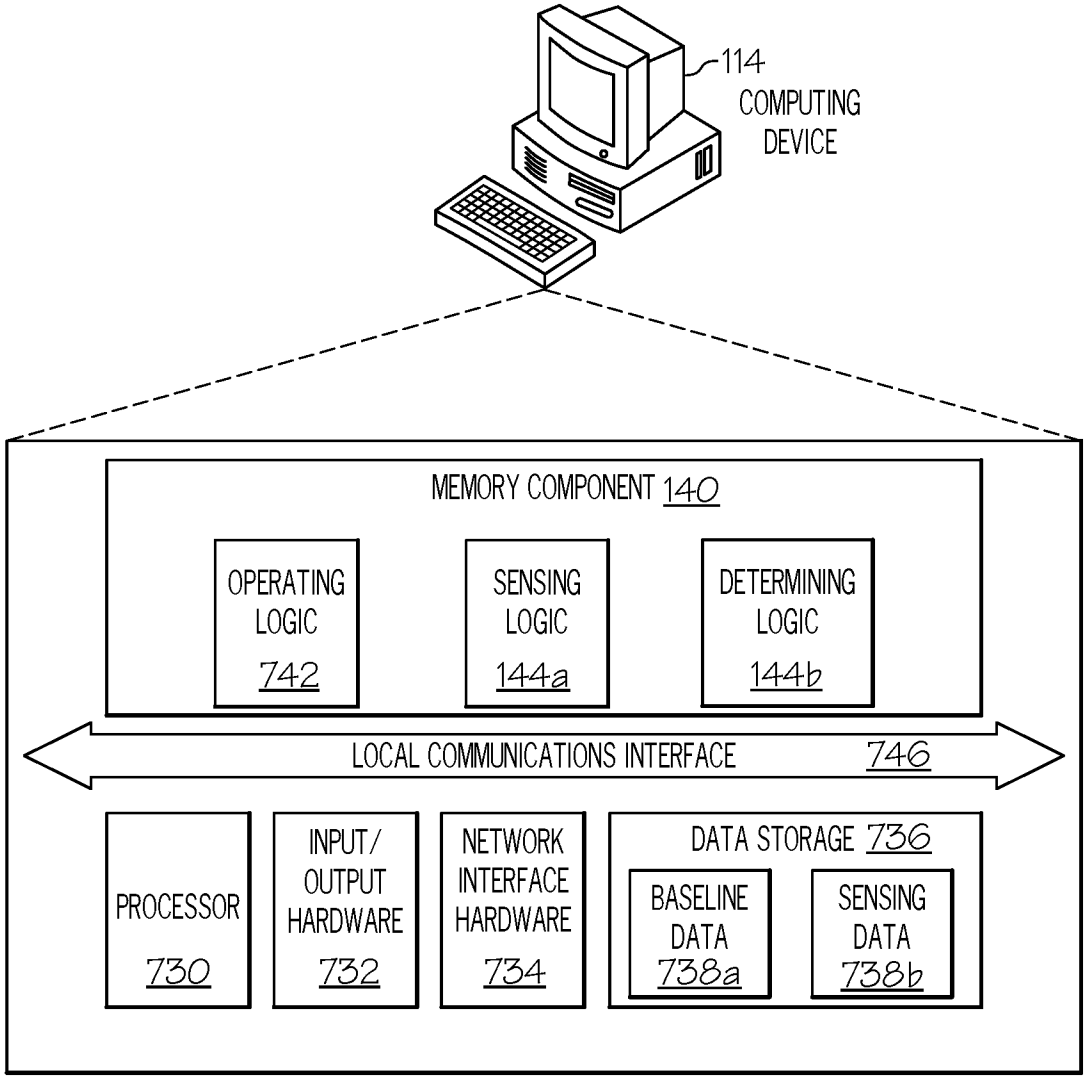
FIG. 7 depicts a computing device for determining a stuck pipe location, according to embodiments describe herein.

FIG. 7 depicts a computing device 114 for determining a stuck pipe location, according to embodiments describe herein. As illustrated, the computing device 114 includes a processor 730, input/output hardware 732, a network interface hardware 734, a data storage component 736 (which stores baseline data 738*a*, sensing data 738*b*, and/or other data), and a memory component 140. The memory component 140 may be configured as volatile and/or nonvolatile memory and as such, may include random access memory (including SRAM, DRAM, and/or other types of RAM), flash memory, secure digital (SD) memory, registers, compact discs (CD), digital versatile discs (DVD) (whether local or cloud-based), and/or other types of non-transitory computer-readable mediums. Depending on the particular embodiment, these non-transitory computer-readable mediums may reside within the computing device 114 and/or external to the computing device 114.

The memory component 140 may store operating logic 742, the sensing logic 144*a*, and the determining logic 144*b*. Each of these logic components may include a plurality of different pieces of logic, each of which may be embodied as a computer program, firmware, and/or hardware, as an example. A local interface 746 is also included in FIG. 7 and may be implemented as a bus or other communication interface to facilitate communication among the components of the computing device 114.

The processor 730 may include any processing component operable to receive and execute instructions (such as from a data storage component 736 and/or the memory component 140). As described above, the input/output hardware 732 may include and/or be configured to interface with speakers, microphones, and/or other input/output components.

The network interface hardware 734 may include and/or be configured for communicating with any wired or wireless networking hardware, including an antenna, a modem, a LAN port, wireless fidelity (Wi-Fi) card, WiMAX card, mobile communications hardware, and/or other hardware for communicating with other networks and/or devices. From this connection, communication may be facilitated between the computing device 114 and other computing devices.

The operating logic 742 may include an operating system and/or other software for managing components of the computing device 114. As discussed above, the sensing logic 144*a* may reside in the memory component 140 and may be configured to cause the processor 730 to interpret signals from the fiber optic sensor 112. The determining logic 144*b* may be configured to cause the processor 730 to utilize the data from the sensing logic 144*a* to determine a location of the obstruction 108.

It should be understood that while the components in FIG. 7 are illustrated as residing within the computing device 114, this is merely an example. In some embodiments, one or more of the components may reside external to the computing device 114 or within other devices. It should also be understood that, while the computing device 114 is illustrated as a single device, this is also merely an example. In some embodiments, the sensing logic 144*a* and the determining logic 144*b* may reside on different devices.

Additionally, while the computing device 114 is illustrated with the sensing logic 144*a* and the determining logic 144*b* as separate logical components, this is also an example. In some embodiments, a single piece of logic may provide the described functionality. It should also be understood that while the sensing logic 144*a* and the determining logic 144*b* are described herein as the logical components, this is also an example. Other components may also be included, depending on the embodiment.

As illustrated above, various embodiments for determining a stuck pipe location are disclosed. These embodiments allow for a single manipulation of the stuck pipe to determine the location of the stuck pipe. Additionally, embodiments described herein utilize the fiber optic sensor to sense the micro-noises caused by stretching of the pipe, while applying tension, compression, or torsion. These embodiments do not need any additional supportive mechanisms on the surface (such as a winch, reel, etc.). A ballast may be used to assist gravity in deploying the sensor down the pipe. This also allows a user to cut the fiber at the coupling with the stuck pipe at the surface and utilize a memory acquisition unit or real-time wireless transmission to the decoding unit for reporting sensor results.

One or more aspects of the present disclosure are described herein. A first aspect of the present disclosure may include a method for stuck pipe detection comprising: determining that a pipe is stuck in a wellbore due to an obstruction; deploying a fiber optic stuck pipe location detector inside the pipe at a first end of the pipe, wherein the fiber optic stuck pipe location detector comprises a first fiber optic sensor and a computing device, wherein deploying the fiber optic stuck pipe location detector inside the pipe comprises allowing gravity to pull at least a portion of the first fiber optic sensor until the first fiber optic sensor reaches a second end of the pipe, and wherein, once deployed, the first fiber optic sensor passively rests inside the pipe without use of a securing mechanism; activating the first fiber optic sensor to detect a baseline acoustic reading and a baseline temperature reading inside the pipe; manipulating the pipe by imparting at least one of tension, compression, or torsion to the pipe, wherein manipulating the pipe causes a stretching of the pipe; detecting, by the first fiber optic sensor, micro-noises caused by the stretching of the pipe; acquiring, by the computing device, data related to the micro-noises from the first fiber optic sensor, wherein acquiring includes at least one of the following: wirelessly acquiring the data or acquiring the data via a memory acquisition; determining a location of the obstruction by comparing at least one of the following: the baseline acoustic reading or the baseline temperature reading with the data related to the micro-noises; and recovering the pipe at a predetermined point around the location of the obstruction while leaving the first fiber optic sensor inside the pipe.

A second aspect of the present disclosure includes the first aspect, wherein the fiber optic stuck pipe location detector is deployed utilizing at least one of the following: electricline, slickline, coiled tubing, or dropping probe method.

A third aspect of the present disclosure includes any of the first and/or second aspects, wherein the fiber optic stuck pipe location detector comprises a ballast attached to the first fiber optic sensor to facilitate deployment of the first fiber optic sensor to the send end of the pipe.

A fourth aspect of the present disclosure includes any of the first through third aspects, wherein the fiber optic stuck pipe location detector further comprises a second sensor, and wherein the method further comprises: deploying the second sensor into the pipe; and utilizing the second sensor to detect the location of the obstruction.

A fifth aspect of the present disclosure includes the any of the first through fourth aspects, wherein the fiber optic stuck pipe location detector further comprises a third fiber optic sensor, and wherein the method further comprises: deploying the third fiber optic sensor into the pipe; and utilizing the third fiber optic sensor to detect the location of the obstruction.

A sixth aspect of the present disclosure includes any of the first through fifth aspects, wherein the first fiber optic sensor detects acoustic changes, wherein the second sensor detects temperature changes, and wherein the third fiber optic sensor detects temperature changes.

A seventh aspect of the present disclosure includes any of the first through sixth aspects further comprising: deploying a pressure sensor inside the pipe; determining a baseline pressure, wherein determining the location of the obstruction includes comparing the baseline pressure to a second pressure reading.

An eighth aspect of the present disclosure includes a method for stuck pipe detection comprising: determining that a pipe is stuck in a wellbore due to an obstruction; deploying a fiber optic stuck pipe location detector inside the pipe at a first end of the pipe, wherein the fiber optic stuck pipe location detector comprises a first fiber optic sensor, a ballast, and a computing device, wherein deploying the fiber optic stuck pipe location detector inside the pipe comprises allowing gravity to pull at least a portion of the first fiber optic sensor until at least one of the first fiber optic sensor or the ballast reaches a second end of the pipe, and wherein, once deployed, the first fiber optic sensor passively rests inside the pipe without use of a securing mechanism; activating the first fiber optic sensor to detect a baseline acoustic reading and a baseline temperature reading inside the pipe; manipulating the pipe by imparting at least one of tension, compression, or torsion to the pipe; detecting, by the first fiber optic sensor, micro-noises caused by manipulating the pipe; wirelessly acquiring, by the computing device, data related to the micro-noises from the first fiber optic sensor; determining a location of the obstruction by comparing the baseline acoustic reading and the baseline temperature reading with the data related to the micro-noises; and recovering the pipe at a predetermined point around the location of the obstruction.

A ninth aspect of the present disclosure includes the eighth aspect, wherein the fiber optic stuck pipe location detector is deployed utilizing at least one of the following: electricline, slickline, coiled tubing, or dropping probe method.

A tenth aspect of the present disclosure includes any of the eighth and/or ninth aspects, wherein the fiber optic stuck pipe location detector further comprises a second sensor, and wherein the method further comprises: deploying the second sensor into the pipe; and utilizing the second sensor to detect the location of the obstruction.

An eleventh aspect includes any of the eighth through tenth aspects, wherein the fiber optic stuck pipe location detector further comprises a third fiber optic sensor, and wherein the method further comprises: deploying the third fiber optic sensor into the pipe; and utilizing the third fiber optic sensor to detect the location of the obstruction.

A twelfth aspect of the present disclosure includes any of the eighth through eleventh aspects, wherein the first fiber optic sensor detects acoustic changes, wherein the second sensor detects pressure changes, and wherein the third fiber optic sensor detects temperature changes.

A thirteenth aspect of the present disclosure includes any of the eighth through twelfth aspects, deploying a pressure sensor inside the pipe; determining a baseline pressure, wherein determining the location of the obstruction includes comparing the baseline pressure to a second pressure reading.

A fourteenth aspect of the present disclosure includes any of the eighth through the thirteenth aspects, wherein manipulating the pipe comprises stretching the pipe.

A fifteenth aspect includes a method for stuck pipe detection comprising: determining that a pipe is stuck in a wellbore due to an obstruction; deploying a first fiber optic sensor inside the pipe at a first end of the pipe, wherein deploying the first fiber optic sensor inside the pipe comprises allowing gravity to pull at least a portion of the first fiber optic sensor until the first fiber optic sensor reaches a second end of the pipe, and wherein, once deployed, the first fiber optic sensor passively rests inside the pipe without use of a securing mechanism; activating the first fiber optic sensor to detect a baseline reading inside the pipe; manipulating the pipe by imparting at least one of tension, compression, or torsion to the pipe; detecting, by the first fiber optic sensor, micro-noises caused by manipulating the pipe; acquiring data related to the micro-noises from the first fiber optic sensor; determining a location of the obstruction by comparing the baseline reading with the data related to the micro-noises; and recovering the pipe at a predetermined point around the location of the obstruction.

A sixteenth aspect includes the fifteenth aspect, wherein the first fiber optic sensor is deployed utilizing at least one of the following: electricline, slickline, coiled tubing, or dropping probe method.

A seventeenth aspect of the present disclosure includes the fifteenth and/or sixteenth aspects, wherein the first fiber optic sensor is coupled to a ballast attached to facilitate deployment of the first fiber optic sensor to the send end of the pipe.

An eighteenth aspect of the present disclosure includes any of the fifteenth through seventeenth aspects, further comprising: deploying a second sensor into the pipe; deploying a third fiber optic sensor into the pipe; and utilizing the second sensor and the third fiber optic sensor to detect the location of the obstruction.

A nineteenth aspect of the present disclosure includes any of the fifteenth through the eighteenth aspects, wherein the first fiber optic sensor detects acoustic changes, wherein the second sensor detects pressure changes, and wherein the third fiber optic sensor detects temperature changes.

A twentieth aspect of the present disclosure includes any of the fifteenth through the nineteenth aspects, deploying a pressure sensor inside the pipe; determining a baseline pressure, wherein determining the location of the obstruction includes comparing the baseline pressure to a second pressure reading.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein.

It should now be understood that embodiments disclosed herein include systems, methods, and non-transitory computer-readable mediums for determining a stuck pipe location. It should also be understood that these embodiments are merely exemplary and are not intended to limit the scope of this disclosure.

What is claimed is:

1. A method for stuck pipe detection comprising:

determining that a pipe is stuck in a wellbore due to an obstruction;

deploying a fiber optic stuck pipe location detector inside the pipe at a first end of the pipe, wherein the fiber optic stuck pipe location detector comprises a first fiber optic sensor and a computing device, wherein deploying the fiber optic stuck pipe location detector inside the pipe comprises allowing gravity to pull at least a portion of the first fiber optic sensor until the first fiber optic sensor reaches a second end of the pipe, and wherein, once deployed, the first fiber optic sensor passively rests inside the pipe without use of a securing mechanism;

activating the first fiber optic sensor to detect a baseline acoustic reading and a baseline temperature reading inside the pipe;

manipulating the pipe by imparting at least one of tension, compression, or torsion to the pipe, wherein manipulating the pipe causes a stretching of the pipe;

detecting, by the first fiber optic sensor, micro-noises caused by the stretching of the pipe;

acquiring, by the computing device, data related to the micro-noises from the first fiber optic sensor, wherein acquiring includes at least one of the following: wirelessly acquiring the data or acquiring the data via a memory acquisition;

determining a location of the obstruction by comparing at least one of the following: the baseline acoustic reading or the baseline temperature reading with the data related to the micro-noises; and recovering the pipe at a predetermined point around the location of the obstruction while leaving the first fiber optic sensor inside the pipe to provide a real time measurement just before making the cut to ensure the pipe is cut at the free pipe above the stuck point.

2. The method of claim 1, wherein the fiber optic stuck pipe location detector is deployed utilising at least one of the following: electricline, slickline, coiled tubing, or dropping probe method.

3. The method of claim 1, wherein the fiber optic stuck pipe location detector comprises a ballast attached to the first fiber optic sensor to facilitate deployment of the first fiber optic sensor to the second end of the pipe.

4. The method of claim 1, wherein the fiber optic stuck pipe location detector further comprises a second sensor, and wherein the method further comprises:

deploying the second sensor into the pipe; and utilizing the second sensor to detect the location of the obstruction.

5. The method of claim 4, wherein the fiber optic stuck pipe location detector further comprises a third fiber optic sensor, and wherein the method further comprises:

deploying the third fiber optic sensor into the pipe; and utilizing the third fiber optic sensor to detect the location of the obstruction.

6. The method of claim 5, wherein the first fiber optic sensor detects acoustic changes, wherein the second sensor detects pressure changes, and wherein the third fiber optic sensor detects temperature changes.

7. The method of claim 1, further comprising:

deploying a pressure sensor inside the pipe;

determining a baseline pressure, wherein determining the location of the obstruction includes comparing the baseline pressure to a second pressure reading.

8. A method for stuck pipe detection comprising:

determining that a pipe is stuck in a wellbore due to an obstruction;

deploying a fiber optic stuck pipe location detector inside the pipe at a first end of the pipe, wherein the fiber optic stuck pipe location detector comprises a first fiber optic sensor, a ballast, and a computing device, wherein deploying the fiber optic stuck pipe location detector inside the pipe comprises allowing gravity to pull at least a portion of the first fiber optic sensor until at least one of the first fiber optic sensor or the ballast reaches a second end of the pipe, and wherein, once deployed, the first fiber optic sensor passively rests inside the pipe without use of a securing mechanism;

activating the first fiber optic sensor to detect a baseline acoustic reading and a baseline temperature reading inside the pipe;

manipulating the pipe by imparting at least one of tension, compression, or torsion to the pipe;

detecting, by the first fiber optic sensor, micro-noises caused by manipulating the pipe;

wirelessly acquiring, by the computing device, data related to the micro-noises from the first fiber optic sensor;

determining a location of the obstruction by comparing the baseline acoustic reading and the baseline temperature reading with the data related to the micro-noises; and recovering the pipe at a predetermined point around the location of the obstruction while leaving the first fiber optic sensor inside the pipe to provide a real time measurement just before making the cut to ensure the pipe is cut at the free pipe above the stuck point.

9. The method of claim 8, wherein the fiber optic stuck pipe location detector is deployed utilizing at least one of the following: electricline, slickline, coiled tubing, or dropping probe method.

10. The method of claim 8, wherein the fiber optic stuck pipe location detector further comprises a second sensor, and wherein the method further comprises:

deploying the second sensor into the pipe; and utilizing the second sensor to detect the location of the obstruction.

11. The method of claim 10, wherein the fiber optic stuck pipe location detector further comprises a third fiber optic sensor, and wherein the method further comprises:

deploying the third fiber optic sensor into the pipe; and utilizing the third fiber optic sensor to detect the location of the obstruction.

12. The method of claim 11, wherein the first fiber optic sensor detects acoustic changes, wherein the second sensor detects pressure changes, and wherein the third fiber optic sensor detects temperature changes.

13. The method of claim 8, further comprising:

deploying a pressure sensor inside the pipe;

determining a baseline pressure, wherein determining the location of the obstruction includes comparing the baseline pressure to a second pressure reading.

14. The method of claim 8, wherein manipulating the pipe comprises stretching the pipe.

15. A method for stuck pipe detection comprising:

determining that a pipe is stuck in a wellbore due to an obstruction;

deploying a first fiber optic sensor inside the pipe at a first end of the pipe, wherein deploying the first fiber optic sensor inside the pipe comprises allowing gravity to pull at least a portion of the first fiber optic sensor until the first fiber optic sensor reaches a second end of the pipe, and wherein, once deployed, the first fiber optic sensor passively rests inside the pipe without use of a securing mechanism;

activating the first fiber optic sensor to detect a baseline reading inside the pipe;

manipulating the pipe by imparting at least one of tension, compression, or torsion to the pipe;

detecting, by the first fiber optic sensor, micro-noises caused by manipulating the pipe;

acquiring data related to the micro-noises from the first fiber optic sensor;

determining a location of the obstruction by comparing the baseline reading with the data related to the micro-noises; and recovering the pipe at a predetermined point around the location of the obstruction while leaving the first fiber optic sensor inside the pipe to provide a real time measurement just before making the cut to ensure the pipe is cut at the free pipe above the stuck point.

16. The method of claim 15, wherein the first fiber optic sensor is deployed utilising at least one of the following: electricline, slickline, coiled tubing, or dropping probe method.

17. The method of claim 16, wherein the first fiber optic sensor is coupled to a ballast attached to facilitate deployment of the first fiber optic sensor to the second end of the pipe.

18. The method of claim 15, further comprising:

deploying a second sensor into the pipe;

deploying a third fiber optic sensor into the pipe; and utilising the second sensor and the third fiber optic sensor to detect the location of the obstruction.

19. The method of claim 18, wherein the first fiber optic sensor detects acoustic changes, wherein the second sensor detects pressure changes, and wherein the third fiber optic sensor detects temperature changes.

20. The method of claim 15, further comprising:

deploying a pressure sensor inside the pipe;

determining a baseline pressure, wherein determining the location of the obstruction includes comparing the baseline pressure to a second pressure reading.

* * * * *